US007703227B2

(12) United States Patent
Carlson

(10) Patent No.: US 7,703,227 B2
(45) Date of Patent: Apr. 27, 2010

(54) ILLUMINATED POSTER FRAME

(76) Inventor: Jon Carlson, 52 Matisse Ct., Pleasant Hill, CA (US) 94523

( * ) Notice: Subject to any disclaimer, the term of this patent is extended or adjusted under 35 U.S.C. 154(b) by 960 days.

(21) Appl. No.: 10/274,476

(22) Filed: Oct. 21, 2002

(65) Prior Publication Data

US 2004/0074129 A1 Apr. 22, 2004

(51) Int. Cl.
*G09F 1/08* (2006.01)

(52) U.S. Cl. ..... 40/541; 40/575

(58) Field of Classification Search ..... 40/575, 40/576, 564, 741, 716, 714, 732, 361, 367, 40/541

See application file for complete search history.

(56) References Cited

U.S. PATENT DOCUMENTS 1,857,882 A * 5/1932 Shipman ..... 40/575
2,029,221 A * 1/1936 Burgess et al. ..... 40/574
4,228,596 A * 10/1980 Daniel ..... 434/344
5,509,223 A * 4/1996 Jung ..... 40/564

* cited by examiner

*Primary Examiner*—Cassandra Davis
(74) *Attorney, Agent, or Firm*—H. Michael Brucker

(57) ABSTRACT

Illuminated poster frame with a frame box including a front frame, side panels and a rear panel, the frame box including a front clear panel. The top panel of the frame box has a slit to removably retain an inner frame that houses a poster. The inner frame has a front frame portion and a rear frame portion to removably retain the poster. The poster is printed on transparent of translucent material capable of transmitting light so that the entire poster is illuminated. The inside of the frame box includes a formed sheet having a plurality of recesses that each retains an amber LED. A translucent sheet placed in front of the LED holding sheet diffuses the light emanating from the LED's. A power source such as a battery supply or a wall pack transformer powers the LED's.

3 Claims, 4 Drawing Sheets

ILLUMINATED POSTER FRAME

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of picture frames and more specifically to an illuminated poster frame.

Posters for movies or TV shows have become a popular form of art and are often framed for hanging on a wall. The posters come in a variety of sizes and include black and white images and well as full color images. In particular, posters that depict images or characters from children's movies or TV shows have become popular items to decorate a child's room.

A deficiency in the current methods of displaying posters is that they can not be seen in a darkened room. They also are difficult and time consuming to remove from a frame so that they may be replaced by another poster.

BRIEF SUMMARY OF THE INVENTION

The primary object of the invention is an poster frame for displaying posters that has a back light feature that illuminates the poster so that it may be seen in a darkened room Another object of the invention is a poster frame that makes it easy to remove and replace the poster. Another object of the invention is a poster frame that uses a plurality amber Leeds as a light source and compensates in the posters colors to adjust to the amber color.

A further object of the invention is a poster frame whose LED light source is dimmable.

Yet another object of the invention is a poster frame that has a relatively thin profile yet evenly distributes the light evenly on the rear of the poster.

Still yet another object of the invention is a poster frame that can be battery operated or powered by a wall power transformer.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Illuminated poster frame comprising: a frame box including a front frame, side panels and a rear panel, said frame box including a front clear panel, the top panel of said frame box having a slit to removably retain an inner frame that houses a poster, said inner frame having a front frame portion and a rear frame portion to removably retain a poster, said poster printed on transparent of translucent material capable of transmitting light so that the entire poster is illuminated, the inside of said frame box including a formed sheet having a plurality of recesses that each retaining an amber LED, a translucent sheet placed in front of said LED holding sheet to diffuse the light emanating from said LED's, and a power source such as a battery supply or a wall pack transformer to power said LED's.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or mariner.

Figure 1:
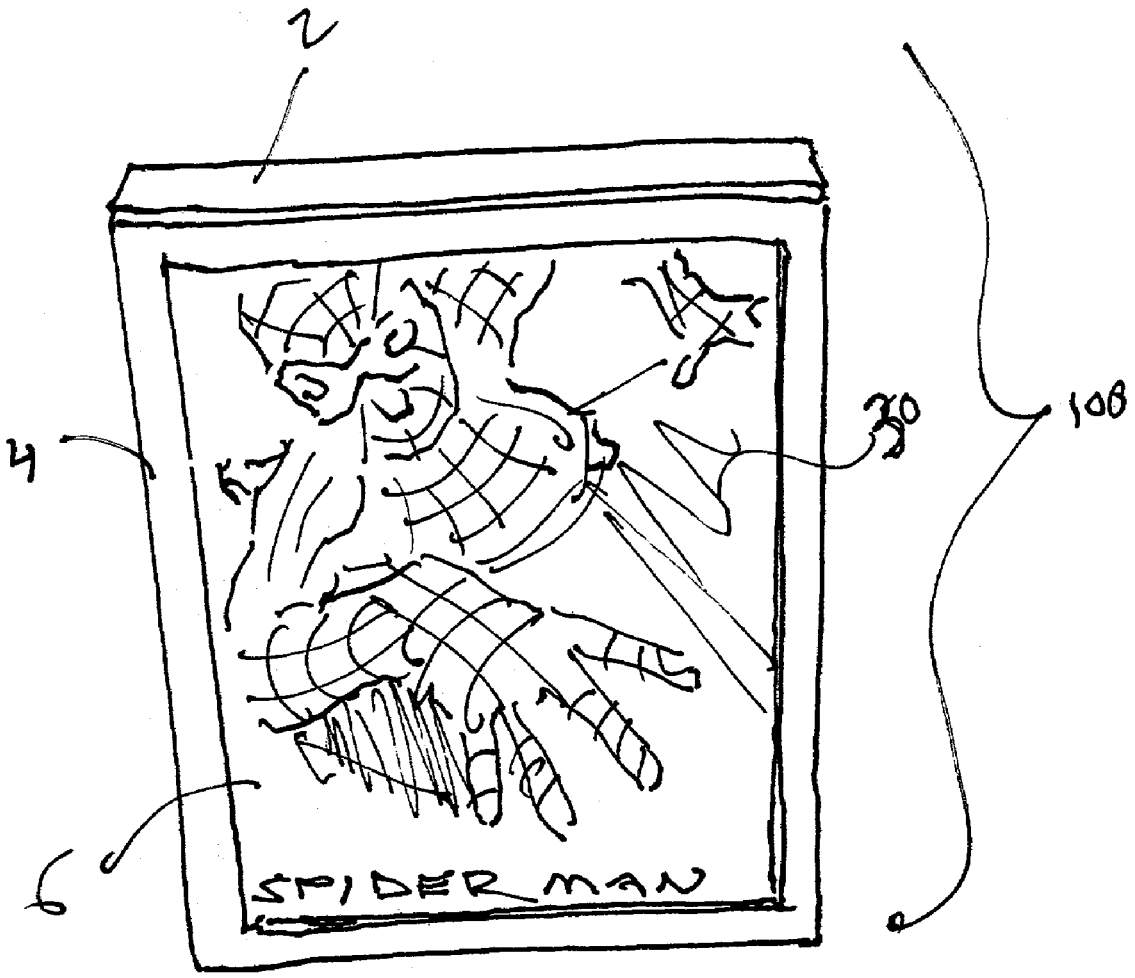
FIG. 1 is a perspective view of the invention.
Figure 3:
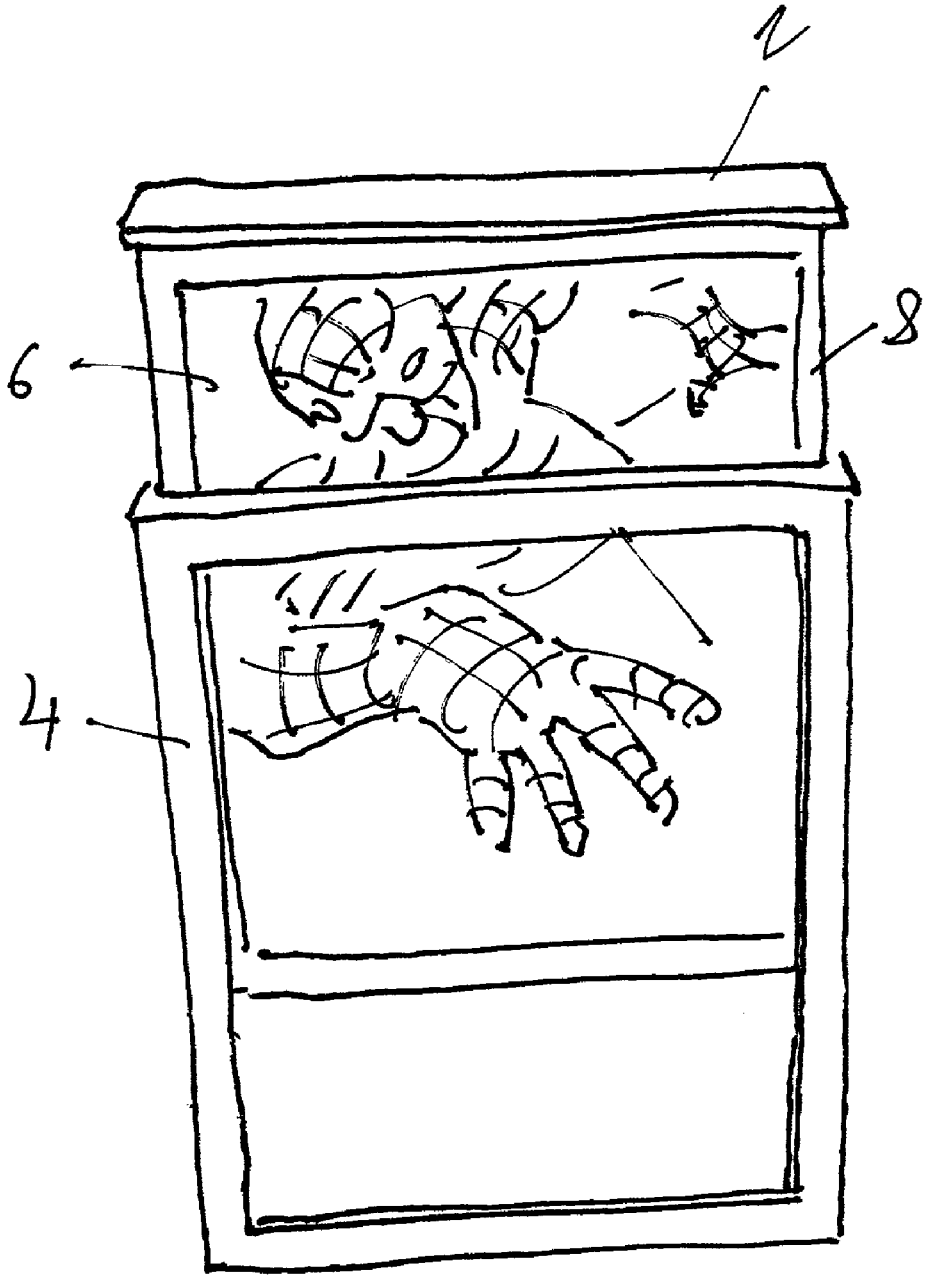
FIG. 3 is a perspective view showing the inner frame being removed.

Referring now to FIG. 1 we see a perspective view of the poster frame of the present invention 100. An outer frame 4 is comprised of a front panel, side panels and a rear panel forming a rectangular box. A poster 6 is viewable through a clear glass or plastic front panel 30. Top panel 2 is a secondary top that, when lifted brings with it attached inner frame 8,9 and poster 6 as shown in FIG. 3. This allows the user to easily remove the poster and replace it with another poster of equal size.

Figure 2:
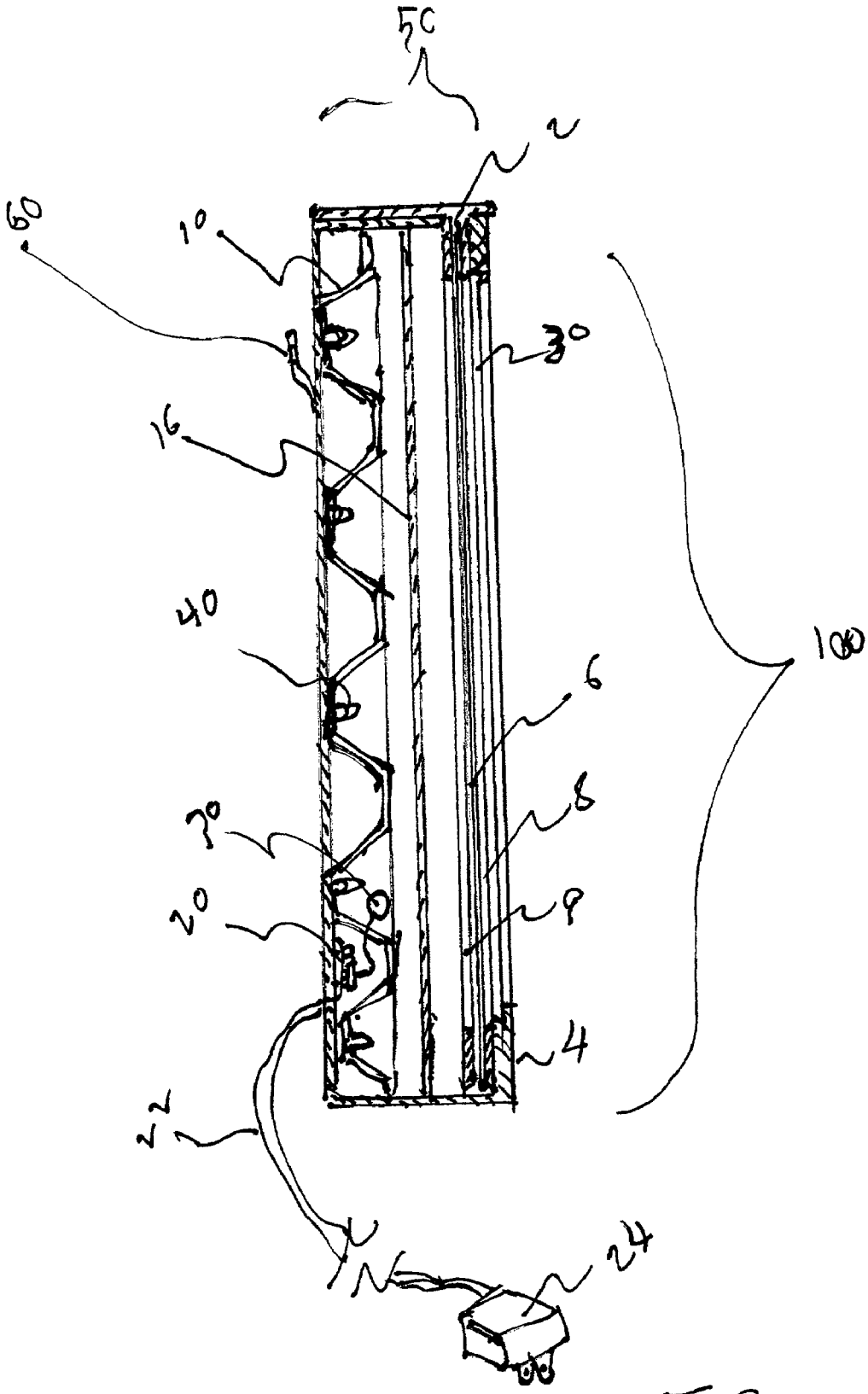
FIG. 2 is a side section view of the present invention.

FIG. 2 shows a side section of the poster frame assembly of the present invention 100. Front panel 4 is backed by clear panel 30. Inner frame 8, 9 houses a poster 6. The poster is printed on transparent or translucent material so that when a light source is shined from the rear of the poster 6, the poster 6 is evenly illuminated so that it can be seen in a darkened room. A formed sheet 10 creates a plurality of depressions that each house and retain an amber LED 40.

Amber LED's 40 have been selected because they are the closest to white light without resorting to expensive white LED's. LED's 40 were chosen for a light source because they are a means to provide light over a relatively large surface area in a relatively even way within a relatively thin profile.

The overall width of side and top panels 50 is only two and three quarters of an inch. Led light 40 is further diffused by a translucent panel 16 so that by the time the light hits the back of poster 6 it is relatively evenly diffused. The entire assembly 100 is thin enough that it can be hung on a wall by hook 60, but thick enough that it can stand on a flat surface such as a table, chest of drawers or nightstand.

The preferred embodiment includes an electronic circuit that can dim the LED's 40 when push button 70 is pressed. The dimmer feature is important for consideration in a child's room where a night light is desired.

Figure 4:
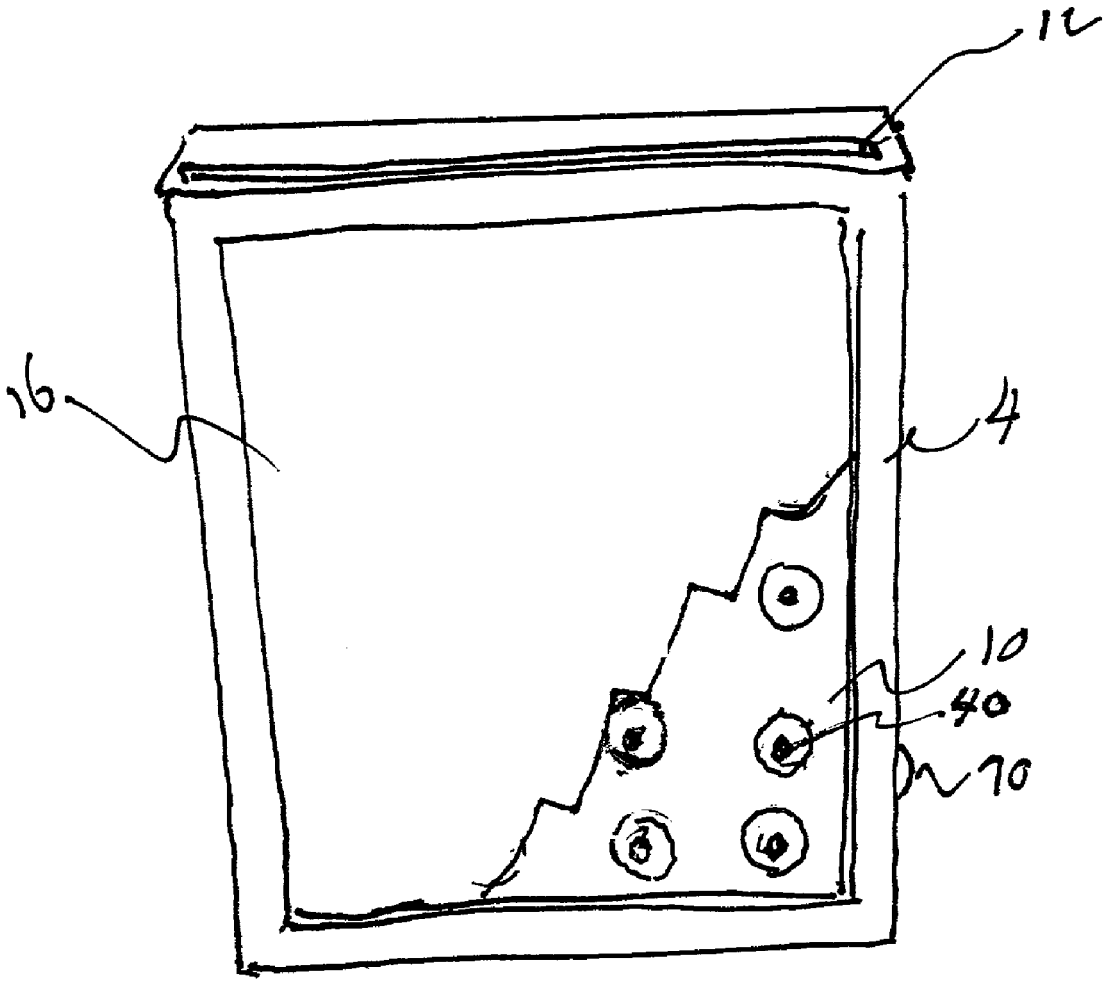
FIG. 4 is a perspective view showing the inner frame completely removed.

FIG. 4 is a view of the frame 4 without the secondary top panel 2 and attached inner frame 8, 9. In this view the translucent sheet 16 can be seen with LED holding sheet 10 and LED's 40 seen faintly behind sheet 16.

The above description and illustrations show the present invention is a novel and improved way to display a frame a poster in an illuminated fashion. The poster can be easily removed and replaced. Obviously, the present invention can be used to illuminate other translucent panels such as photographs and the like.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Illuminated poster frame comprising:

a frame box including a front frame, side panels, a top panel and a rear panel;

said frame box including a front clear panel;

said top panel of said frame box having a slit removably retaining an inner frame that houses a poster;

said inner frame having a front frame portion and a rear frame portion removably retaining a poster;

said poster printed on transparent or translucent material capable of transmitting light so that the entire poster is illuminated;

the inside of said frame box including a formed sheet having a plurality of recesses that each retain an amber LED;

a translucent sheet place in front of said LED's to diffuse the light emanating from said LED's; and, a power source to power said LED's.

2. Illuminated poster frame as claimed in claim 1 wherein said poster is color compensated to produce a natural look even when said LED light source is amber in color.

3. Illuminated poster frame as claimed in claim 1 wherein said LED's are dimmable by an electronic circuit.

* * * * *